US009574582B2

(12) United States Patent
Edmonson et al.

(10) Patent No.: US 9,574,582 B2
(45) Date of Patent: Feb. 21, 2017

(54) HYDRAULIC PUMP SYSTEM AND METHOD OF OPERATION

(71) Applicant: Fluid Ride, LTD., East Lansing, MI (US)

(72) Inventors: Jeremy Richard Edmonson, East Lansing, MI (US); Joshua Coombs, East Lansing, MI (US)

(73) Assignee: Fluid Ride, Ltd., East Lansing, MI (US)

( * ) Notice: Subject to any disclaimer, the term of this patent is extended or adjusted under 35 U.S.C. 154(b) by 711 days.

(21) Appl. No.: 13/868,923

(22) Filed: Apr. 23, 2013

(65) Prior Publication Data

US 2013/0276439 A1 Oct. 24, 2013

Related U.S. Application Data

(60) Provisional application No. 61/636,854, filed on Apr. 23, 2012.

(51) Int. Cl.
*F15B 15/00* (2006.01)
*F15B 1/26* (2006.01)
(Continued)

(52) U.S. Cl.
CPC ..... *F15B 15/00* (2013.01); *F15B 1/26* (2013.01); *F15B 21/005* (2013.01); *F15B 21/041* (2013.01);
(Continued)

(58) Field of Classification Search
CPC ..... F15B 1/265; F15B 1/022; F15B 1/024; F15B 21/005; F15B 21/041; F15B 21/042; F15B 2211/20592; F15B 2211/613
See application file for complete search history.

(56) References Cited

U.S. PATENT DOCUMENTS 2,070,440 A 2/1937 Maddin
2,828,960 A 4/1958 Rene et al.
(Continued)

FOREIGN PATENT DOCUMENTS

DE 102007018664 A1 * 10/2008 ..... F15B 1/024
EP 0279507 A 8/1988
(Continued)

OTHER PUBLICATIONS

Artemis Intelligent Power Ltd Packet—date unknown.
(Continued)

*Primary Examiner* — John K Fristoe, Jr.
*Assistant Examiner* — Matthew Wiblin
(74) *Attorney, Agent, or Firm* — Jeffery Schox; Diana Lin

(57) ABSTRACT

A fluid management system includes a hydraulic main pump fluidly connected to a load, an accumulator fluidly connected to the hydraulic main pump, a secondary pump, a fluid preparation system fluidly connected between an outlet of the secondary pump and an inlet of the hydraulic main pump, a reservoir, and a valve system fluidly connecting the reservoir, an outlet of the hydraulic main pump, and the secondary pump inlet. The system is at least operable between a run mode, wherein the secondary pump and accumulator cooperatively maintain the pressure within the hydraulic main pump, and a charging mode, wherein the secondary pump pumps fluid into the accumulator until a threshold volume is reached.

16 Claims, 6 Drawing Sheets

(51) Int. Cl.

| | |
|---|---|
| ***F15B 21/00*** | (2006.01) |
| *F15B 21/04* | (2006.01) |
| *F15B 21/06* | (2006.01) |

(52) U.S. Cl.

CPC ..... *F15B 21/042* (2013.01); *F15B 21/06* (2013.01); *F15B 2201/515* (2013.01); *F15B 2211/20592* (2013.01); *F15B 2211/611* (2013.01); *F15B 2211/613* (2013.01); *F15B 2211/625* (2013.01); *F15B 2211/6658* (2013.01)

(56) References Cited

U.S. PATENT DOCUMENTS 2,946,582 A 7/1960 Martin
3,031,853 A 5/1962 Olson
3,149,830 A 9/1964 Broadwell
3,154,317 A 10/1964 Gustafsson
3,156,251 A 11/1964 Edmond
3,222,866 A * 12/1965 Lehmann ..... E02F 9/22 210/167.31
3,582,106 A 6/1971 Keijzer
3,603,576 A 9/1971 Hahn
3,627,348 A 12/1971 Klees
3,653,676 A 4/1972 Higginbotham
3,696,710 A 10/1972 Ortelli
3,709,517 A 1/1973 Wossner
3,717,355 A 2/1973 De
3,871,635 A 3/1975 Unruh et al.
3,875,851 A 4/1975 Foster
3,885,809 A 5/1975 Pitcher
3,895,816 A 7/1975 Takahashi et al.
3,895,820 A 7/1975 Takahashi et al.
3,913,938 A * 10/1975 Aikawa ..... B60G 17/0152 280/6.158
3,940,163 A 2/1976 Davis et al.
3,945,664 A 3/1976 Hiruma
3,947,004 A 3/1976 Taylor
3,961,336 A 6/1976 Walker et al.
4,070,950 A 1/1978 Cyphelly
4,145,073 A 3/1979 Mcluckie et al.
4,298,318 A 11/1981 Tsuchiya et al.
4,306,638 A 12/1981 Malott
4,371,317 A 2/1983 Heibel
4,389,045 A 6/1983 Taylor
4,411,447 A 10/1983 Hart
4,441,593 A 4/1984 Axthammer
4,556,718 A 12/1985 Chastrette et al.
4,558,767 A 12/1985 Taylor
4,589,678 A 5/1986 Lund
4,607,861 A 8/1986 Eisenberg et al.
4,634,143 A 1/1987 Asami et al.
4,643,437 A 2/1987 Salant et al.
4,652,008 A 3/1987 Davis
4,659,106 A 4/1987 Fujita et al.
4,691,276 A 9/1987 Miller et al.
4,696,489 A 9/1987 Fujishiro et al.
4,718,648 A 1/1988 Taylor
4,729,459 A 3/1988 Inagaki et al.
4,735,402 A 4/1988 Davis
4,741,416 A 5/1988 Tanigawa
4,741,516 A 5/1988 Davis
4,752,062 A 6/1988 Domenichini
4,768,627 A 9/1988 Taylor
4,809,179 A 2/1989 Klingler et al.
4,828,230 A 5/1989 Steger et al.
4,867,286 A 9/1989 Taylor
4,872,702 A 10/1989 Medley
4,877,222 A 10/1989 Davis
4,880,086 A 11/1989 Knecht et al.
4,881,753 A 11/1989 Shima et al.
4,888,696 A 12/1989 Akatsu et al.
5,011,180 A 4/1991 Dunwoody
5,014,829 A 5/1991 Hare, Sr.
5,020,826 A * 6/1991 Stecklein ..... B60G 17/04 267/64.23
5,029,328 A 7/1991 Kamimura et al.
5,033,770 A 7/1991 Kamimura et al.
5,043,893 A 8/1991 Aburaya et al.
5,049,039 A 9/1991 Knoth et al.
5,054,808 A 10/1991 Tsukamoto
5,062,658 A 11/1991 Majeed
5,070,970 A 12/1991 Johnston et al.
5,071,157 A 12/1991 Majeed
5,071,158 A 12/1991 Yonekawa et al.
5,080,392 A 1/1992 Bazergui
5,082,308 A 1/1992 Jones
5,098,119 A 3/1992 Williams et al.
5,103,396 A 4/1992 Hiwatashi et al.
5,103,397 A 4/1992 Ikemoto et al.
5,104,143 A 4/1992 Yonekawa
5,105,358 A 4/1992 Takase et al.
5,105,918 A 4/1992 Hagiwara et al.
5,113,345 A 5/1992 Mine et al.
5,119,297 A 6/1992 Buma et al.
5,130,926 A 7/1992 Watanabe et al.
5,137,299 A 8/1992 Jones
5,144,559 A 9/1992 Kamimura et al.
5,152,547 A 10/1992 Davis
5,156,645 A 10/1992 Tsukamoto et al.
5,162,995 A 11/1992 Ikemoto et al.
5,163,706 A 11/1992 Maguran, Jr. et al.
5,174,598 A 12/1992 Sato et al.
5,177,681 A 1/1993 Sato
5,190,446 A 3/1993 Salter et al.
5,195,619 A 3/1993 Dourson et al.
5,208,749 A 5/1993 Adachi et al.
5,217,245 A 6/1993 Guy
5,231,583 A 7/1993 Lizell
5,234,203 A 8/1993 Smith
5,239,471 A 8/1993 Takahashi
5,246,235 A 9/1993 Heinzen
5,259,738 A 11/1993 Salter et al.
5,261,455 A 11/1993 Takahashi et al.
5,265,913 A 11/1993 Scheffel
5,269,556 A 12/1993 Heyring
5,277,281 A 1/1994 Carlson et al.
5,282,649 A 2/1994 Williams et al.
5,295,563 A 3/1994 Bennett
5,301,412 A 4/1994 Hahn et al.
5,305,859 A 4/1994 Davis
5,316,272 A 5/1994 Davis
5,326,229 A 7/1994 Collins
5,335,757 A 8/1994 Knecht et al.
5,348,338 A 9/1994 Kuriki et al.
5,351,790 A 10/1994 Machida
5,423,402 A 6/1995 De Kock
5,480,011 A 1/1996 Nagai et al.
5,486,018 A 1/1996 Sakai
5,522,481 A 6/1996 Watanabe
5,527,251 A 6/1996 Davis
5,536,036 A 7/1996 Ehrlich
5,540,448 A 7/1996 Heinzen
5,570,287 A 10/1996 Campbell et al.
5,572,425 A 11/1996 Levitt et al.
5,577,579 A 11/1996 Derr
5,584,498 A 12/1996 Danek
5,593,176 A 1/1997 Campbell et al.
5,595,372 A 1/1997 Patten
5,598,337 A 1/1997 Butsuen et al.
5,619,413 A 4/1997 Oakley
5,627,751 A 5/1997 Davis et al.
5,630,623 A 5/1997 Ganzel
5,632,502 A 5/1997 Oppitz et al.
5,671,142 A 9/1997 Tatarazako
5,679,187 A 10/1997 Price
5,684,698 A 11/1997 Fujii et al.
5,730,261 A 3/1998 Spakowski et al.
5,769,400 A 6/1998 Hoelzl et al.
5,788,028 A 8/1998 Bieber
5,878,851 A 3/1999 Carlson et al.
5,879,137 A 3/1999 Yie
5,944,153 A 8/1999 Ichimaru

(56) References Cited

U.S. PATENT DOCUMENTS

| | | | |
|---|---|---|---|
| 5,979,501 | A | 11/1999 | Kim et al. |
| 5,988,599 | A | 11/1999 | Forbis |
| 6,003,872 | A | 12/1999 | Nord |
| 6,017,023 | A | 1/2000 | Greuter et al. |
| 6,024,366 | A | 2/2000 | Masamura |
| 6,032,090 | A | 2/2000 | Von Bose |
| 6,095,541 | A | 8/2000 | Turner et al. |
| 6,105,987 | A | 8/2000 | Turner |
| 6,119,829 | A | 9/2000 | Nakadate |
| 6,120,009 | A | 9/2000 | Gatehouse et al. |
| 6,142,477 | A | 11/2000 | Meinzer |
| 6,145,859 | A | 11/2000 | Altherr et al. |
| 6,155,391 | A | 12/2000 | Kashiwagi et al. |
| 6,202,010 | B1 | 3/2001 | Shono et al. |
| 6,216,831 | B1 | 4/2001 | Taylor |
| 6,217,010 | B1 | 4/2001 | McNeely |
| 6,227,167 | B1 | 5/2001 | Smith et al. |
| 6,234,500 | B1 | 5/2001 | Aufrance |
| 6,247,683 | B1 | 6/2001 | Hayakawa et al. |
| 6,250,658 | B1 | 6/2001 | Sakai |
| 6,259,982 | B1 | 7/2001 | Williams et al. |
| 6,264,212 | B1 | 7/2001 | Timoney |
| 6,267,387 | B1 | 7/2001 | Weiss |
| 6,282,470 | B1 | 8/2001 | Shono et al. |
| 6,293,530 | B1 | 9/2001 | Delorenzis et al. |
| 6,305,272 | B1 | 10/2001 | Lin |
| 6,305,673 | B1 | 10/2001 | Delorenzis et al. |
| 6,318,521 | B1 | 11/2001 | Niaura et al. |
| 6,318,737 | B1 | 11/2001 | Marechal et al. |
| 6,321,888 | B1 | 11/2001 | Reybrouck et al. |
| 6,328,125 | B1 | 12/2001 | Van Den et al. |
| 6,361,033 | B1 | 3/2002 | Jones et al. |
| 6,389,341 | B1 | 5/2002 | Davis |
| 6,394,238 | B1 | 5/2002 | Rogala |
| 6,397,134 | B1 | 5/2002 | Shal et al. |
| 6,402,128 | B1 | 6/2002 | Trowbridge |
| 6,416,061 | B1 | 7/2002 | French et al. |
| 6,418,363 | B2 | 7/2002 | Cochofel et al. |
| 6,470,248 | B2 | 10/2002 | Shank et al. |
| 6,486,018 | B2 | 11/2002 | Roberts et al. |
| 6,513,797 | B2 | 2/2003 | Sawai |
| 6,517,094 | B1 | 2/2003 | Kincaid et al. |
| 6,523,845 | B2 | 2/2003 | Stiller |
| 6,556,907 | B1 | 4/2003 | Sakai |
| 6,598,885 | B2 | 7/2003 | Delorenzis et al. |
| 6,679,504 | B2 | 1/2004 | Delorenzis et al. |
| 6,811,167 | B2 | 11/2004 | Coombs et al. |
| 6,811,168 | B2 | 11/2004 | Acker et al. |
| 6,811,171 | B2 | 11/2004 | Sakai |
| 6,814,364 | B2 * | 11/2004 | Coombs ..... B60G 7/001 280/124.154 |
| 6,871,866 | B2 | 3/2005 | Gloceri et al. |
| 6,886,841 | B2 | 5/2005 | Coombs et al. |
| 6,978,871 | B2 | 12/2005 | Holiviers |
| 7,413,063 | B1 | 8/2008 | Davis |
| 7,438,164 | B2 | 10/2008 | Groves et al. |
| 7,441,640 | B2 | 10/2008 | Russell |
| 7,472,914 | B2 | 1/2009 | Anderson et al. |
| 7,478,708 | B2 | 1/2009 | Bugaj |
| 7,641,181 | B2 | 1/2010 | Delorenzis |
| 7,641,208 | B1 | 1/2010 | Barron et al. |
| 7,707,378 | B2 | 4/2010 | Ganesan et al. |
| 7,740,256 | B2 | 6/2010 | Davis |
| 7,743,896 | B2 | 6/2010 | Vanhees et al. |
| 7,770,701 | B1 | 8/2010 | Davis |
| 7,770,902 | B1 | 8/2010 | Davis |
| 7,950,506 | B2 | 5/2011 | Nowaczyk |
| 2002/0195789 | A1 | 12/2002 | Coombs et al. |
| 2003/0075881 | A1 | 4/2003 | Delorenzis et al. |
| 2003/0090080 | A1 | 5/2003 | Trotter et al. |
| 2003/0132071 | A1 | 7/2003 | Coombs et al. |
| 2004/0188897 | A1 | 9/2004 | Edmondson et al. |
| 2005/0073125 | A1 | 4/2005 | Coombs et al. |
| 2006/0039795 | A1 | 2/2006 | Stein et al. |
| 2006/0118346 | A1 | 6/2006 | Rampen et al. |
| 2007/0258832 | A1 | 11/2007 | Caldwell et al. |
| 2008/0048405 | A1 | 2/2008 | Delorenzis et al. |
| 2008/0111324 | A1 | 5/2008 | Davis |
| 2008/0206073 | A1 | 8/2008 | Caldwell et al. |
| 2008/0245322 | A1 | 10/2008 | Stein et al. |
| 2008/0258484 | A1 | 10/2008 | Caldwell et al. |
| 2008/0275606 | A1 | 11/2008 | Tarasinski et al. |
| 2008/0284118 | A1 | 11/2008 | Venton-Walters et al. |
| 2010/0044978 | A1 | 2/2010 | Delorenzis et al. |
| 2010/0193308 | A1 | 8/2010 | Nowaczyk et al. |
| 2010/0326780 | A1 | 12/2010 | Murakami |
| 2011/0202236 | A1 | 8/2011 | Galasso et al. |

FOREIGN PATENT DOCUMENTS

| | | | |
|---|---|---|---|
| EP | 0427046 | A | 5/1991 |
| EP | 718496 | A | 6/1996 |
| GB | 2154700 | A | 9/1985 |
| JP | 2009255785 | A | 11/2009 |

OTHER PUBLICATIONS

Dow Corning Packet—date unknown.

Ikenaga et al., "Active Suspension Control Using a Novel Strut and Active Filtered Feedback Design and Implementation," Proc. 1999 IEEE International Conference on Control Applications, Kohala Coast-Island of Hawaii, Hawaii, Aug. 22-27, 1999, pp. 1502-1508.

* cited by examiner

HYDRAULIC PUMP SYSTEM AND METHOD OF OPERATION

CROSS-REFERENCE TO RELATED APPLICATIONS

This application claims the benefit of U.S. Provisional Application No. 61/636,854 filed 23 Apr. 2012, which is incorporated in its entirety by this reference.

TECHNICAL FIELD

This invention relates generally to the hydraulic system field, and more specifically to an improved hydraulic system with a low pressure accumulator in the hydraulic main pump field.

BACKGROUND

Typical hydraulic pump systems include a hydraulic pump that pumps and/or cycles fluid to a hydraulic device to do work (for example, to drive a hydraulic motor of a vehicle or to drive a hydraulic suspension system of a vehicle). In the operation of hydraulic pumps, a substantially continuous supply of fluid to the hydraulic pump is desired to minimize or prevent cavitation (i.e., interruptions of fluid supply to the hydraulic pump) within the hydraulic pump, which may damage or decrease the efficiency of the hydraulic pump. Hydraulic systems also typically lose fluid due to evaporation, leaks, and/or inefficiencies that further increases the risk of an interruption of fluid supply to the hydraulic pump. To overcome these issues, hydraulic systems typically include a fluid reservoir with additional fluid that compensates for fluid loss within the system. However, drawing fluid from a reservoir may not be sufficient to supply uninterrupted fluid supply for hydraulic pumps, in particular, for high speed hydraulic pumps that may be used in hydraulic vehicles or hydraulic suspension systems that require substantially fast response time of the hydraulic circuit. Additionally, some hydraulic pumps may operate better when the fluid entering the hydraulic pump is at a pressure that is higher than atmospheric. To provide a substantially continuous supply of pressurized fluid to a hydraulic pump also serves as a challenge. Some hydraulic systems in the field utilize low pressure supercharge pumps to increase the pressure/aid the flow of fluid to the hydraulic pump. However, such supercharge pumps may not be fast enough to provide enough fluid at the desired pressure under high speed conditions. Alternatively, large supercharge pumps may be utilized, but such large supercharge pumps may be expensive and costly to operate. In other hydraulic systems, a low pressure accumulator may be used to "store" fluid at an increased pressure that is readily available to the hydraulic pump when necessary. However, hydraulic systems that utilize such low pressure accumulators must maintain a certain volume of pressurized fluid within the low pressure accumulator and may include a system dedicated to maintaining the low pressure accumulator, which may be substantially costly, complicated to manage and maintain, and consume a substantially large amount of energy. In systems that aim to utilize hydraulic power as a means to replace fossil fuels, using such methods to main low pressure accumulators may not be an attractive option.

Thus, there is a need in the hydraulic pump field to create an improved hydraulic system with a low pressure accumulator that provides a substantially continuous supply of fluid for a hydraulic pump.

DESCRIPTION

The following description of the invention is not intended to limit the invention to these preferred embodiments, but rather to enable any person skilled in the art to make and use this invention.

Figure 1:
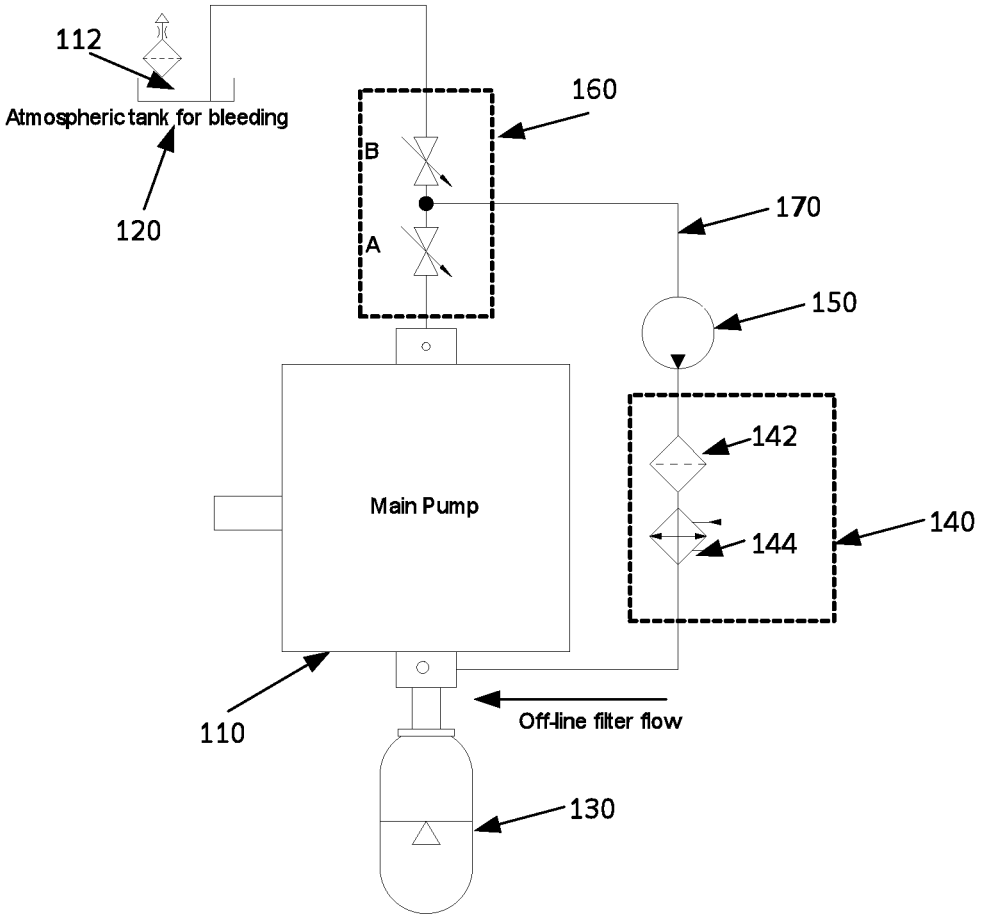
FIG. 1 is a schematic representation of the system for managing fluid in a fluid system with a hydraulic pump that displaces fluid.

As shown in FIG. 1, the system 100 for managing fluid in a fluid system with a hydraulic main pump 110 that displaces a fluid 112 includes a reservoir 120 that contains a portion of the fluid 112 at a first pressure, an accumulator 130 coupled to the hydraulic main pump 110 that contains another portion of the fluid 112 at a second pressure that is higher than the first pressure and that supplies the hydraulic main pump with fluid, a fluid preparation system 140 that prepares the fluid 112 to be used by the hydraulic main pump 110, a secondary pump 150 configured to operate in one of at least two modes: a first mode to displace fluid 112 from the outlet of the hydraulic main pump 110 through the fluid preparation system 140 to the inlet of the hydraulic main pump 110 (to "run" the fluid system) and a second mode to displace fluid 112 from the reservoir 120 to the accumulator 130 (to "charge" the accumulator 130), and a valve system 160 configured to direct fluid 112 in one of at least two paths: a first path from the outlet of the hydraulic main pump 110 to the secondary pump 150 and a second path from the reservoir 120 to the secondary pump 150. The secondary pump 150 may also be configured for a third mode to displace fluid from at least one of the outlet of the hydraulic main pump 110 and the accumulator 130 back to the reservoir 120 (to "purge" the accumulator 130 and/or the fluid system in response to a purge request). In this variation, the valve system 160 is preferably also configured to direct fluid in a third path from at least one of the outlet of the hydraulic main pump 110 and the accumulator 130 to the reservoir 120. The system 100 may also include piping 170 that functions to allow fluid to flow within the system 100. The hydraulic main pump no may include a single hydraulic pump, but may alternatively be a plurality of hydraulic pumps, as shown in FIGS. 2-5. The hydraulic main pump can be an actively controlled pump (e.g., with actively controlled poppet valves), but can alternatively be a passively controlled pump or any other suitable pump. The hydraulic main pump 110 can additionally include a fluid manifold (e.g., internal reservoir) that couples the accumulator 130 and fluid preparation system 140 to the hydraulic pump(s) that form the hydraulic main pump 110. The fluid manifold preferably fluidly connects to the inlets of the hydraulic pumps, but can alternatively fluidly connect to the outlets of the hydraulic pumps or a combination. The fluid manifold preferably connects the accumulator 130 and hydraulic pumps in parallel, but can alternatively connect the components in series or in any suitable combination thereof. The fluid manifold can additionally couple the accumulator 130 and hydraulic pump(s) to the valve system 160. Alternatively, the hydraulic main pump 110 can include a first fluid manifold connecting the accumulator 130 to the hydraulic pump(s) and a second fluid manifold connecting the accumulator 130 to the valve system 160. The first fluid manifold can connect the hydraulic pump(s) to the valve system 160, or the system can include a third fluid manifold that connects the hydraulic pump(s) to the valve system 160. The "inlet" and the "outlet" of the hydraulic main pump 110 may be defined as where fluid directly enters and exits the hydraulic main pump no, respectively (e.g., wherein the inlet is the end of the fluid manifold fluidly connected to the secondary pump and/or the accumulator 130, and the outlet is the end of the fluid manifold fluidly connected to the valve system), but may alternatively be defined as where fluid from the fluid system is provided to the hydraulic main pump 110 and where fluid is removed from the hydraulic main pump no back into the fluid system, respectively, as shown in FIGS. 2-5. More specifically, fluid may interchangeably enter and exit certain types of hydraulic pumps through the same fluid path, as shown in FIGS. 2-5 where there are two hydraulic pumps within the hydraulic main pump no. In such variations of the hydraulic main pump no, the "inlet" is defined as where fluid from the fluid system is provided to the hydraulic main pump no (e.g., the fluid path including the fluid manifold connecting the constituent pumps) and the "outlet" is defined as where the fluid is removed from the hydraulic main pump 100 back into the fluid system. The hydraulic main pump no can have multiple inlets, multiple outlets, a single inlet, a single outlet, or any other suitable combination of inlets and outlets. Alternatively, the inlet can be the inlet of the constituent pump of the hydraulic main pump, and the outlet can be the outlet of the constituent pump of the hydraulic main pump, wherein the fluid manifold can function as an internal reservoir for the hydraulic main pump no. However, any other suitable arrangement of the inlet and outlet may be used. The inlet of the hydraulic main pump no can additionally include a valve D that selectively directs fluid from the fluid preparation system 140 to the hydraulic main pump no or to the accumulator 130. Alternatively, the inlet of the hydraulic main pump no can be substantially open, wherein the higher pressure of the accumulator 130 and/or fluid egressing from the fluid preparation system 140 prevent fluid backflow out of the hydraulic main pump inlet. The fluid connection between the accumulator 130 and the hydraulic main pump no can alternatively or additionally include a valve that selectively permits fluid flow from the accumulator 130 to the hydraulic main pump no and from the fluid preparation system 140 to the accumulator 130.

Figure 2A:
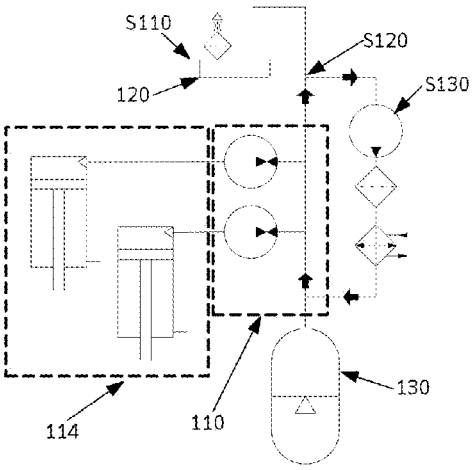
FIGS. 2*a*, 2*b*, and 2*c* are a schematic representation of the method for managing fluid in a fluid system with a hydraulic pump that displaces fluid, in the run mode, fluid compensation, and charge mode, respectively.
Figure 2B:
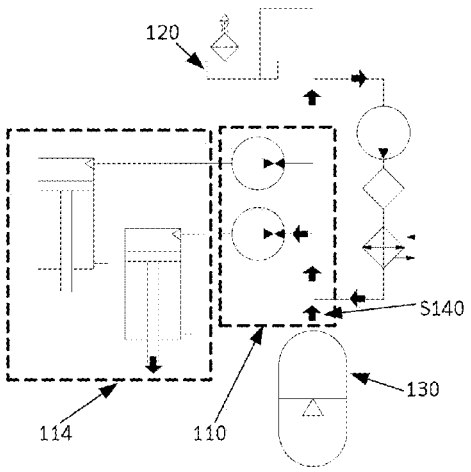
Figure 2C:
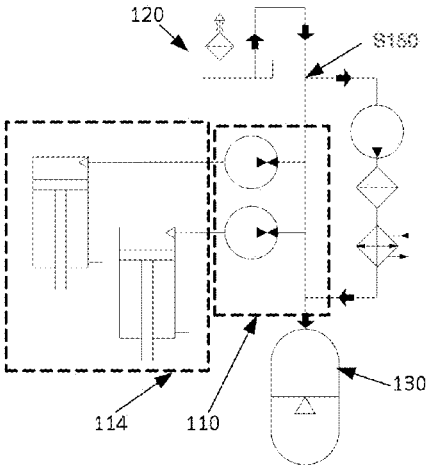
Figure 3:
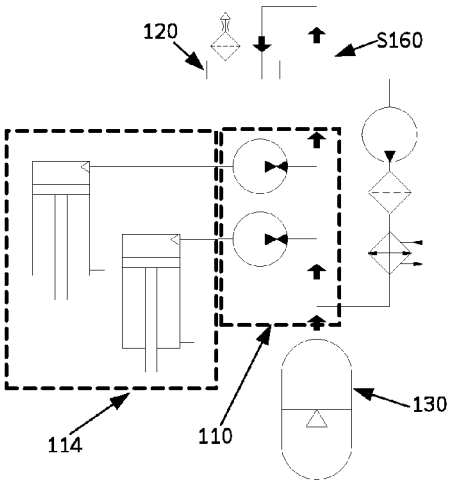
FIG. 3 is a schematic representation of the purge mode.

As shown in FIGS. 2*a*-2*c*, the method S100 for managing fluid in a fluid system with a hydraulic main pump that displaces fluid includes the steps of supplying a fluid from a reservoir Step S110, directing fluid between the inlet and outlet of the hydraulic main pump Step S120, directing fluid from the outlet of the hydraulic main pump to a secondary pump that pumps the fluid to a fluid preparation system that prepares (e.g., conditions) fluid for use by the hydraulic main pump before returning to the inlet of the hydraulic main pump in the "run" mode Step S130, compensating for fluid lost between the inlet and outlet of the hydraulic main pump by supplying additional fluid from an accumulator Step S140, and directing fluid from the reservoir to the secondary pump to pump fluid from the reservoir into the accumulator when the level of fluid in the accumulator is below a certain threshold (in other words, when the level of fluid is below a "low fluid level" threshold) in the "charge" mode Step S150. The method S100 may also include removing fluid from the accumulator back to the reservoir in the "purge" mode Step S160, as shown in FIG. 3. The "low fluid level" threshold (first threshold) is preferably determined at least in part from the maximum volume of fluid that may be required to supplement fluid supply to the hydraulic main pump at any one time. For example, the amount of fluid of in the "low fluid level" threshold may be the volume of fluid necessary to run the hydraulic main pump if all the fluid were to be lost between the inlet and outlet of the hydraulic main pump and a certain amount of time is necessary before an emergency stop of the hydraulic main pump is activated. The "low fluid level" threshold may be a predetermined level, but may alternatively be a dynamic threshold that actively changes to compensate for changes in the ambient temperature, fluid temperature, total fluid volume in the fluid system, and/or changing load requirements. In particular, changes in fluid temperature may cause the fluid density to change and changes in ambient temperature may cause the range of operating temperatures of fluid to change. However, the "low fluid level" threshold may be determined using any other suitable method.

As mentioned above, typical hydraulic systems that utilize low pressure accumulators include substantially complex, expensive, and high energy use systems that maintain the low pressure accumulator. For example, in the hydraulic system, there may be a low pressure accumulator fluid maintenance system that operates substantially separately from the hydraulic main pump fluid system. Additionally, hydraulic main pumps may operate better with a certain quality of fluid, for example, hydraulic main pumps may become damaged when unwanted sediment or contaminants (such as particulates or entrained gas such as air) are contained within the fluid going through the hydraulic main pump. Furthermore, hydraulic main pumps may operate better with fluid at a certain temperature. Thus, fluid systems typically also include a fluid preparation system that prepares fluid prior to the inlet to the hydraulic main pump. Typical hydraulic systems also include a secondary pump that functions to direct fluid through the fluid preparation system. This allows the hydraulic main pump to function to pump fluid to a load without the hindrance of also driving fluid through the fluid preparation system. As a result, typical fluid systems with hydraulic main pumps may be relatively complicated and costly. As shown in FIGS. 1 and 2 and described above, the system 100 and method S100 functions to utilize a secondary pump to function to drive the fluid through a fluid preparation system 140 (that preferably includes a filtration system 142 and/or a fluid cooling system 144 or any other suitable type of fluid preparation devices) and back to the hydraulic main pump no in a first mode and to function to maintain the low pressure accumulator in a second mode. This allows one hydraulic system to maintain the hydraulic main pump no, the fluid preparation system, and the low pressure accumulator, which may significantly decrease complexity, cost, and energy usage of the hydraulic system.

The system 100 and method S100 for managing fluid in a fluid system with a hydraulic main pump 110 is preferably used to maintain a substantially continuous supply of fluid 112 to the hydraulic main pump no. The hydraulic main pump no is preferably used to power a load 114, as shown in FIG. 2*a*. For example, the hydraulic main pump 110 may drive a hydraulic suspension strut that is used to provide suspension in a vehicle, such as the compressible fluid strut as described in U.S. Pat. No. 5,988,599 entitled "Compressible Fluid Strut" and issued on 24 Jan. 2005, which is incorporated in its entirety by this reference, but may alternatively be any other suitable type of hydraulic suspension strut. The hydraulic main pump 110 may also be used to power a hydraulic motor used to drive, for example, a vehicle. However, the hydraulic main pump 110 may be used to power any other suitable load. The hydraulic main pump 110 is preferably of a type that includes a fluid inlet and a fluid outlet. The fluid inlet and the fluid outlet may be separate orifices, but may alternatively be the same orifice. The hydraulic main pump 110 is preferably of a type that drives fluid through to the load 114 and removes fluid from the load 114. In the variation of the load 114 that is a hydraulic suspension strut, the hydraulic main pump 110 functions to drive additional fluid to the hydraulic suspension strut when additional fluid is needed (for example, for increased suspension spring force, in response to an increased suspension spring force request) and to remove extraneous fluid from the hydraulic suspension strut when less fluid is needed (for example, for decreased suspension spring force, in response to an decreased suspension spring force request). The hydraulic main pump no is preferably of a digital displacement pump/motor as described in U.S. Pat. No. 5,259,738 entitled "Fluid Working Machine" and issued on 9 Nov. 1993, which is incorporated in its entirety by this reference, but may alternatively be any other suitable type of hydraulic main pump.

In the variation where the hydraulic main pump no functions to pump fluid to a the hydraulic suspension strut of U.S. Pat. No. 5,988,599, the fluid 112 is preferably a compressible fluid and cooperates to supply the suspending spring force hydraulic suspension strut. The fluid 112 is preferably a silicone fluid that compresses about 1.5% volume at 2,000 psi, about 3% volume at 5,000 psi, and about 6% volume at 10,000 psi. Above 2,000 psi, the compressible fluid has a larger compressibility than conventional hydraulic oil. The compressible fluid, however, may alternatively be any suitable fluid, with or without a silicon component that provides a larger compressibility above 2,000 psi than conventional hydraulic oil. In the variation where the hydraulic main pump 110 functions to pump fluid to a hydraulic motor that drives a vehicle, the fluid 112 is preferably also a compressible fluid because the hydraulic main pump 110 may function to displace the fluid 112 in packets of fluid, and not in a continuous stream of fluid flow. This may cause the hydraulic motor to not run as smoothly as when supplied with a continuous stream of fluid flow. The compressibility of the fluid 112 in this variation cooperates with the hydraulic main pump 110 to decrease the impact of a non-continuous stream of fluid flow to the performance of the hydraulic main pump no. Additionally, in the variation where the load 114 is a hydraulic motor that drives a vehicle, because the hydraulic motor may experience, through backdrive, the irregularities of the road that the vehicle may encounter, for example, bumps or change in friction. Such irregularities in the road may cause the hydraulic motor to stall or increase speed, thus disrupting the flow of fluid 112 through the fluid system. The compressibility of the fluid 112 may function to dampen the effect of the disruption to the flow of the fluid 112 through the hydraulic system 100. For example, if the hydraulic motor stalls for a substantially short period of time, the flow of the fluid 112 is temporarily halted while the hydraulic main pump 110 continues to pump fluid through the system. If an incompressible fluid is used, the increase in flow pressure is directly transmitted to the hydraulic main pump no. If a compressible fluid is used, the increase of pressure is dampened through the compressibility of the fluid 112 and is not directly transmitted to the hydraulic main pump 110. However, any other suitable type of fluid may be used in the fluid system.

The reservoir 120 functions to store a portion of the fluid 112 at a first pressure. The first pressure is preferably of atmospheric pressure, decreasing the need for a pressure system that manages the reservoir 120, but may alternatively be of any other suitable pressure. The reservoir pressure is preferably equilibrated with the ambient environment through a vent or opening. Alternatively, the reservoir can be substantially sealed, or configured to hold a pressure seal. The reservoir 120 is preferably coupled to the fluid system and preferably supplies the fluid system with fluid 112. More preferably, the reservoir 120 is fluidly coupled to the fluid system through the valve system, but can be otherwise coupled to the system. The reservoir 120 is preferably of a material that is substantially chemically inert when in contact with the fluid 112. Alternatively, the reservoir 120 may include material that is chemically reactive when in contact with the fluid 112, where the chemically reactive material may function as a temporal indicator. The temporal indicator may inform the user or maintenance personnel of the age of the fluid 112 contained within the reservoir 120 and/or may instruct the user or the maintenance personnel of the need to replace the fluid 112. However, the reservoir 120 may be constructed of any other suitable material. The reservoir 120 is preferably of a shape that is substantially similar to a rectangular prism, but may alternatively be of any suitable shape that contains a suitable volume of fluid 112. The reservoir 120 preferably includes an orifice that is selectively opened and closed that allows for the fluid 112 to be removed and/or added to the reservoir 120. The orifice may also be selectively opened to remove contaminants in the fluid 112. The orifice can additionally include a particulate filter to prevent particulate egress into the fluid system. Alternatively, the reservoir 120 may include an orifice for the removal of the fluid 112 and/or contaminants and another orifice for the addition of the fluid 112. The reservoir 120 may also include a fluid level sensor to determine the amount of fluid within the reservoir 120. However, the reservoir 120 may be of any other suitable type, material, shape, or volume.

Figure 4:
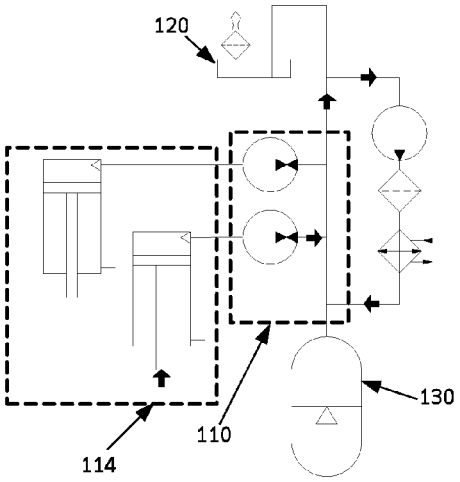
FIG. 4 is a schematic representation of fluid flow when the hydraulic pump extracts extra fluid from the load.

The accumulator 130 functions to store another portion of the fluid 112 at a second pressure that is higher than the first pressure. When there is a need for additional fluid 112 to the hydraulic main pump no (for example, when fluid is lost due to inefficiencies in the fluid system), the accumulator 130 functions to provide the additional fluid 112 to the hydraulic main pump no. Similarly, as shown in FIG. 4, in the variation of the hydraulic main pump no that functions to remove fluid 112 from the load, the accumulator 130 may also function to store the additional fluid 112. Because the fluid 112 within the accumulator 130 is at a higher pressure than the reservoir 120 and the accumulator 130 is preferably arranged in closer proximity to the hydraulic main pump no, fluid 112 from the accumulator 130 reaches the inlet of the hydraulic main pump substantially faster than the fluid 112 from the reservoir 120, thus allowing the hydraulic main pump 110 to operate without any substantial interruption in supply of fluid 112. The second pressure is preferably a pressure substantially similar to the desired inlet fluid pressure for the hydraulic main pump no. The desired inlet fluid pressure for the hydraulic main pump 110 is preferably selected based upon the optimal operating conditions of the hydraulic main pump 110, for example, an inlet pressure that increases the efficiency of operation of the hydraulic main pump or increases the longevity of the hydraulic main pump 110, but may alternatively be selected using any other suitable method or criteria. Alternatively, the second pressure may be higher than the desired inlet fluid pressure for the hydraulic main pump 110 to compensate for any expected loss in pressure during flow from the accumulator 130 to the inlet of the hydraulic main pump no. However, any other suitable second pressure may be used. The accumulator 130 is preferably a low pressure accumulator that includes a container and a pressurizing mechanism. The container contains a portion of the fluid 112, and is preferably structured to withstand and sustain the desired pressure of the pressurized fluid 112 inside. The pressurizing mechanism can be a volume of pressurized gas, as shown in FIG. 1, that provides a force on the fluid 112 within the accumulator 130 to increase the pressure of the fluid 112. The pressurized gas is preferably substantially immiscible with the fluid 112 under the second pressure of the accumulator 130, but can alternatively have any other suitable properties. Alternatively, the pressurizing mechanism can be a sprung wall that applies pressure to the fluid 112, a weight that provides pressure to the fluid 112, or any other suitable source of pressure to pressurize the fluid 112. However, the accumulator may be of any other suitable type.

The accumulator 130 preferably also includes a fluid level sensor that functions to determine the level of fluid 112 contained within the accumulator. The fluid sensor may be a sensor contained within the accumulator 130 that senses the level of the fluid 112, for example, an ultrasonic sensor or a wave sensor that detects wave changes that result from propagation through a fluid. In the variation of the accumulator 130 with a sprung wall that moves with the level of fluid, the location of the sprung wall may also be detected. In the variation of the accumulator 130 with pressurized gas, the pressure of the gas may be detected to determine the actual volume that the gas is occupying and assuming that the remainder of the volume is taken up by the fluid. In this variation, the temperature of the gas is also used to determine the volume of the gas. To determine the initial amount of gas within the accumulator 130, or to calibrate the sensor, the accumulator 130 may be "purged" using the third mode of the secondary pump 150 (in other words, substantially all of the fluid 112 is removed from the accumulator 130. However, any other suitable type of fluid level sensor may be used.

The system 100 is configured to operate in one of at least two modes: a first mode to displace fluid 112 from the outlet of the hydraulic main pump 110 through the fluid preparation system 140 to the inlet of the hydraulic main pump no (to "run" the fluid system) and a second mode to displace fluid 112 from the reservoir 120 to the accumulator 130 (to "charge" the accumulator 130). The system 100 may also be configured to operate in a third mode to displace fluid from at least one of the outlet of the hydraulic main pump no and the accumulator 130 back to the reservoir 120 (to "purge" the accumulator 130 and/or the fluid system). Because the pressure within the fluid system is higher than that of the reservoir 120, the secondary pump 150 in the third mode may be configured to be off to allow the pressure difference to drive fluid from the fluid system into the reservoir 120 to "purge" the accumulator 130 and/or the fluid system. Alternatively, the secondary pump 150 in the third mode may be configured to drive fluid within the fluid system towards the reservoir 120. However, any other suitable operation of the secondary pump 120 in the third mode may be used. The system 100 preferably operates in one mode at a time, but may alternatively operate in more than one mode concurrently, for example, the system 100 may operate in both the "run" mode and the "charge" mode concurrently to both displace fluid between the inlet and outlet of the hydraulic main pump no and charge the accumulator 130. The system 100 preferably additionally includes a controller 162 configured to control the valve system (e.g., valves A and B), the secondary pump 150, and/or the valve of the hydraulic pump inlet to achieve the aforementioned modes. The secondary pump 150 may be substantially similar to the hydraulic main pump 110 or a pump within the hydraulic main pump 110, but may alternatively be different. Alternatively, the secondary pump 150 can be the hydraulic main pump 110, be a pump within the hydraulic main pump 110, or be any other suitable pump. The secondary pump 150 is preferably packaged within the same package as the hydraulic main pump 110, but can alternatively be packaged in a separate housing. The secondary pump 150 is preferably driven by the same shaft or power source as the hydraulic main pump 110, but can alternatively be driven by a different shaft or power source from the hydraulic main pump 110. In the variation where the pressure necessary to displace fluid 112 through the fluid preparation system 140 is lower than the second pressure of the accumulator 130, the secondary pump 150 is preferably of a pump that increases the pressure of the fluid 112 to at least the second pressure of the fluid 112 in the accumulator 130. The secondary pump 150 may also increase the pressure of the fluid 112 to above the second pressure of the accumulator 130 to compensate for any pressure loss between the fluid preparation system 140 and the travel distance of the fluid 112 to the accumulator 130. The variation where the pressure necessary to displace the fluid 112 through the fluid preparation system 140 is higher than the second pressure of the accumulator 130, the secondary pump 150 preferably increases the pressure of the fluid 112 to at least the pressure necessary to displace fluid through the fluid preparation system 140. In the second mode of the secondary pump 150, the secondary pump 150 may also function to displace fluid through the fluid preparation system 140 to the accumulator 130, as shown in FIGS. 1-5. In this variation, the secondary pump 150 preferably increases the pressure of the fluid 112 such that, after pressure loss through the fluid preparation system 140, the fluid 112 is still at least the second pressure of the accumulator 130. However, the secondary pump 150 may function to increase the fluid 112 to any other suitable pressure.

Figure 5:
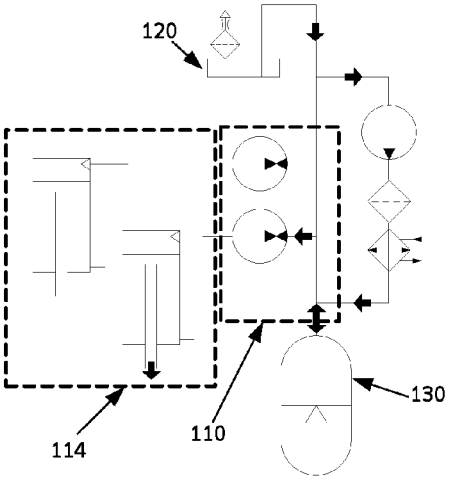
FIG. 5 is a schematic representation of fluid flow when the secondary motor both charges the accumulator and compensates for fluid loss in the hydraulic pump.

As described above, once the level of fluid within the accumulator 130 is determined to be below a certain "low fluid level" threshold (for example, a volume of the fluid 112 has been supplied to the hydraulic main pump no), the secondary pump 150 functions to "charge" the accumulator 130 from the reservoir 120. The secondary pump 150 preferably charges the accumulator 130 using fluid proximal the bottom of the reservoir 120 (e.g., wherein the bottom is a location within the reservoir furthest along a gravity vector) to prevent intake of fluid that may contain contaminants (for example, particulates or entrained gases such as air) that may enter the reservoir 120 and float to the top of the reservoir 120. The fluid is preferably drawn from a sidewall of the reservoir 120 adjacent the reservoir bottom, but can alternatively be drawn from the reservoir bottom or from any other portion of the reservoir 120. During "charge," the secondary pump 150 may displace a volume of fluid into the accumulator 130 until a "high fluid level" threshold (second threshold), which is preferably higher than the "low fluid level" threshold, is reached. This provides the accumulator 130 with a buffer of fluid volume between the "low fluid level" threshold and the "high fluid level" threshold where the accumulator 130 may operate without substantial maintenance, which may decrease the number of times that the secondary pump 150 switches between the first mode and second mode of operation. Similar to the "low fluid level" threshold, the "high fluid level" threshold may be a predetermined threshold, but may alternatively be a dynamic threshold that actively changes to compensate for changes in the ambient temperature, fluid temperature, total fluid volume in the fluid system, and/or changing load requirements. Alternatively, during "charge," the secondary pump 150 may function to displace a volume of fluid into the accumulator 130 until the fluid level is no longer below the "low fluid level" threshold. However, the secondary pump 150 may function to displace any suitable volume of fluid into the accumulator 130 to any suitable threshold. As shown in FIG. 5, during "charge," the secondary pump 150 may also function to displace fluid to the hydraulic main pump no. This may be particular useful in the usage scenario where there is fluid loss in the fluid system and the fluid level in the accumulator 30 is below the "low fluid level" threshold.

Figure 6:
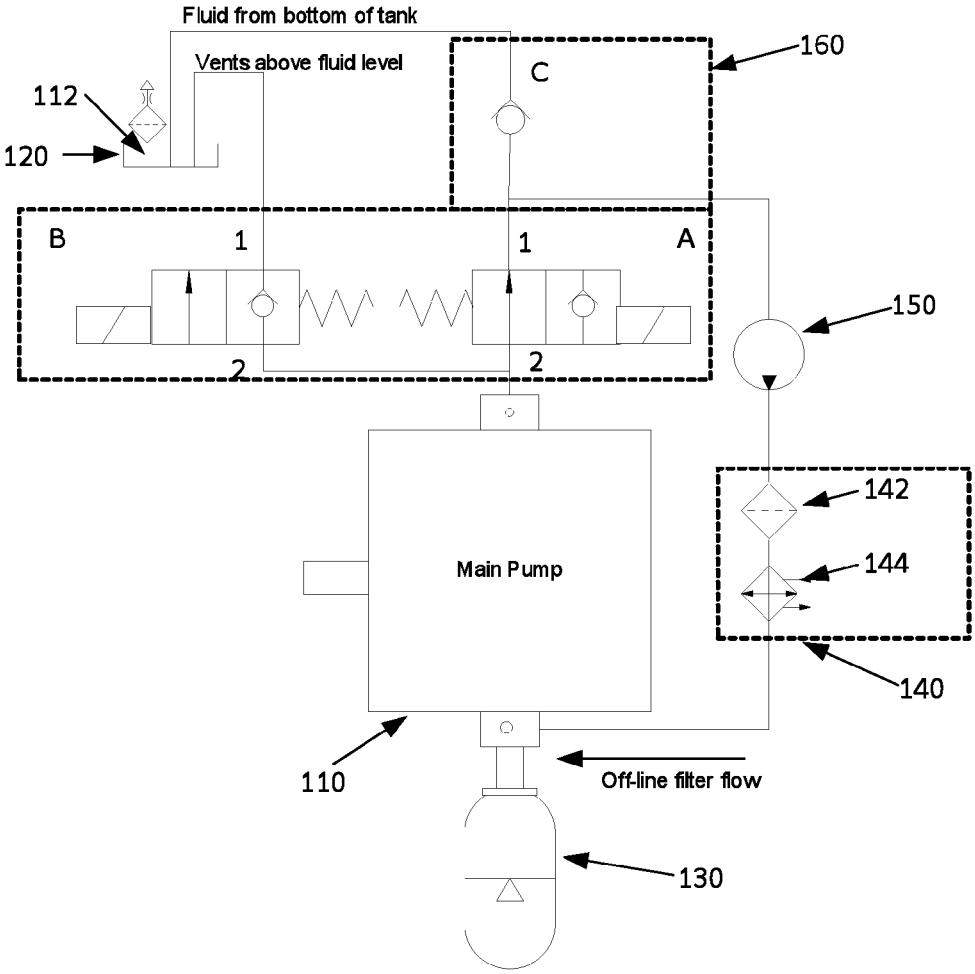
FIGS. 6 and 7 are a second and third variation for the valve system, respectively.
Figure 7:
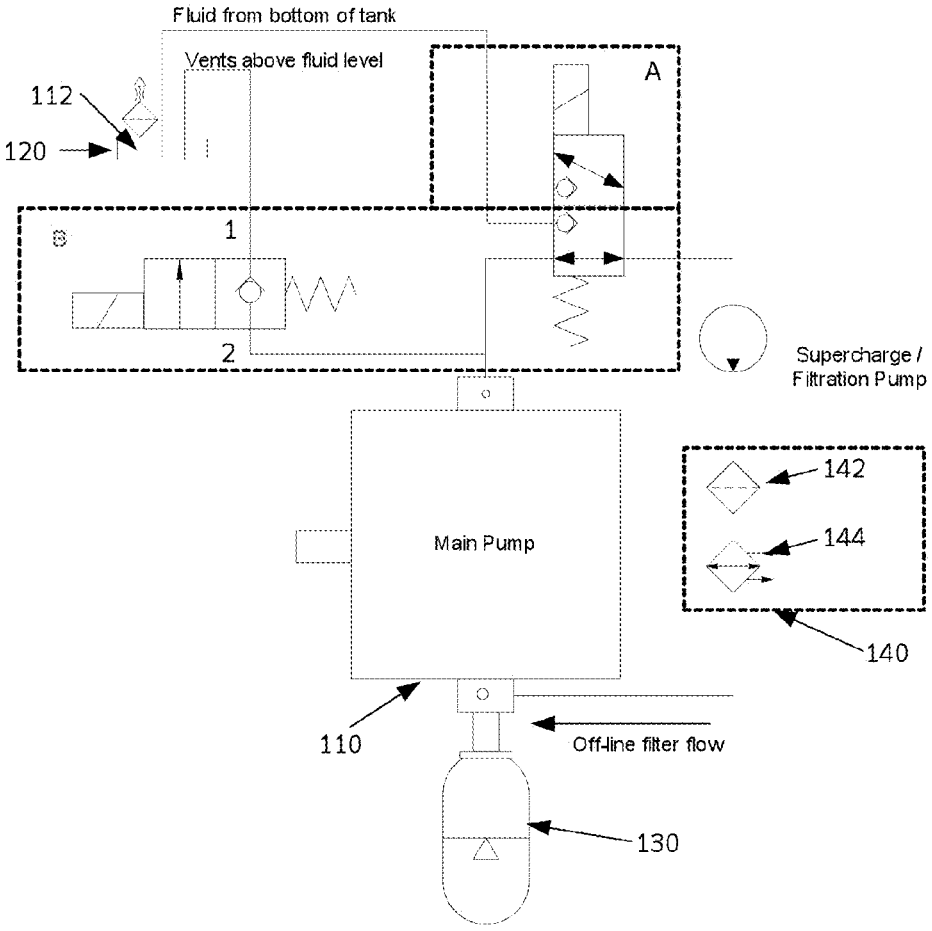
Figure 8:
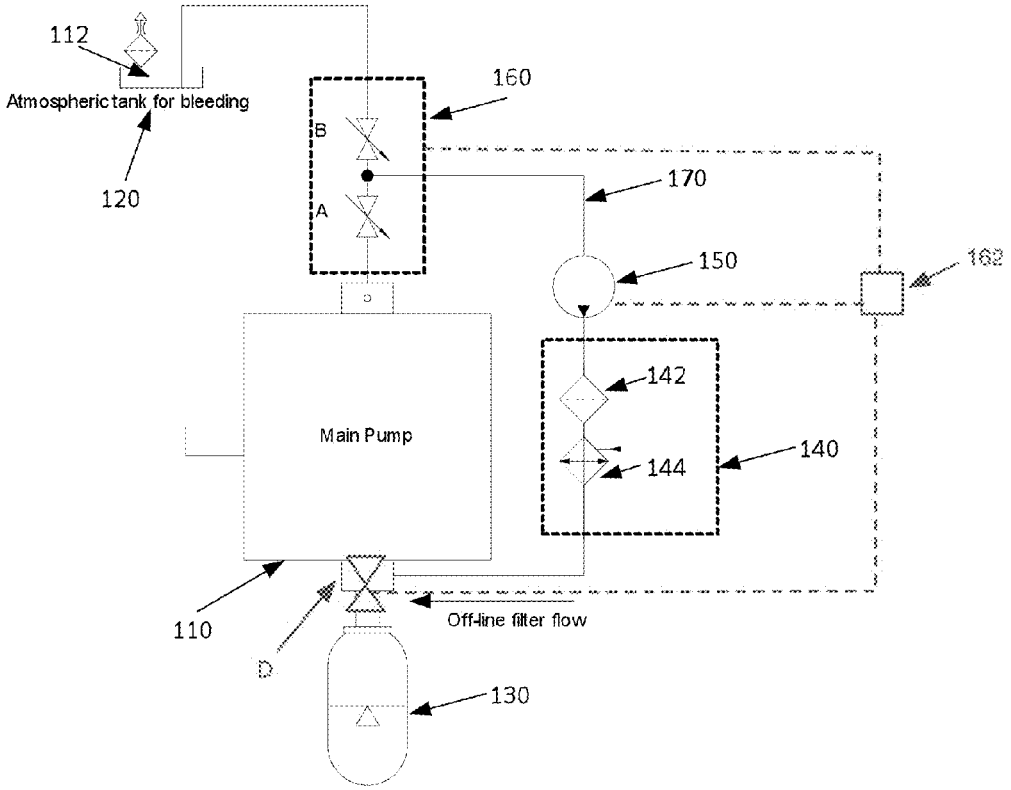
FIG. 8 is a specific example of the system.

The valve system 160 is configured to direct fluid 112 in one of at least two paths: a first path from the outlet of the hydraulic main pump no to the secondary pump 150 (as shown in FIG. 2*a*) and a second path from the reservoir 120 to the secondary pump 150 (as shown in FIG. 2*c*). The valve system 160 may also function to direct fluid 112 in a third path from at least one of the outlet of the hydraulic main pump 110 and the accumulator 130 to the reservoir 120 (as shown in FIG. 3). The valve system 160 functions to allow the secondary pump 150 to function in one of the two (or three) modes, thus allowing one hydraulic system to maintain the hydraulic main pump 110, the fluid preparation system, and the low pressure accumulator, which may significantly decrease complexity, cost, and energy usage of the hydraulic system. The valve system 160 preferably includes a plurality of valves that are configured in one of several variations (as shown in FIGS. 1, 6, and 7) that cooperate to direct fluid in the desired path within the fluid system. The valves of the valve system 160 are preferably each of an active valve type that may be triggered to be OPEN, CLOSED, or allow flow in any particular direction, for example, a solenoid valve. Alternatively each of the valves of the valve system 160 may be of a passive type that only allows flow in one direction and prevents flow from any other direction, for example, a duck-bill valve or any other type of check valve. In this variation, the direction of flow as dictated by the operation mode of the secondary pump 150 may function to open and/or close the valves in the valve system 160. Alternatively, the valves in the valve system 160 may be a combination of active and passive valves or any other suitable type of valve arranged to direct fluid in any suitable path as shown in FIGS. 2 and 3.

In a first variation, as shown in FIG. 1, the valve system 160 may include active valves A and B that function to direct fluid. In this first variation, the second valve B is preferably a bi-directional valve that allows fluid to flow in two directions through the valve. In a second variation, as shown in FIG. 6, the valve system 160 may include active valves A and B and a check valve C, allowing each of valve A and valve B to be single direction valves. In a third variation, as shown in FIG. 7, the valve system 160 may include active valves A and B, where the valve A is a bi-directional valve that may take input from either the reservoir 120 or the outlet of the hydraulic main pump 110 and output fluid to the secondary pump 150. This allows fluid 112 that flows from the reservoir 120 and fluid that flows to the reservoir 120 to be remain separated, which may decrease the risk of contamination of fluid (for example, with particulates or entrained gas such as air) going into the hydraulic main pump 110. While the valve system 160 is preferably of a variation as described above, the valve system 160 may be any other suitable number and arrangement of any suitable type of valve.

As mentioned above, the system 100 may also include piping 170 that functions to allow fluid to flow within the system 100. The piping 170 may each be of any suitable length or geometry. This allows for the components of the fluid system to be placed in any suitable location relative to the load 114. The piping 170 is preferably composed of material that is substantially chemically inert to the fluid 112 and that is capable of withstanding the fluid pressure used in the fluid system. However, any other suitable type of piping may be used.

As a person skilled in the art will recognize from the previous detailed description and from the figures and claims, modifications and changes can be made to the preferred embodiments of the invention without departing from the scope of this invention defined in the following claims.

We claim:

1. A fluid management system comprising:

a hydraulic main pump fluidly connected to a load, the hydraulic main pump further comprising an internal reservoir, the internal reservoir having an inlet and an outlet;

an accumulator fluidly connected to the internal reservoir inlet;

a secondary pump having a secondary pump inlet and a secondary pump outlet;

a fluid preparation system fluidly connected between the secondary pump outlet and the internal reservoir inlet;

a reservoir configured to contain a volume of fluid at an ambient pressure;

a valve system fluidly connecting the reservoir, the internal reservoir outlet, and the secondary pump inlet; wherein the valve system comprises:

a fluid manifold fluidly connecting the internal reservoir outlet and the secondary pump inlet to the reservoir;

a first valve arranged along the fluid manifold, between the internal reservoir outlet and the secondary pump inlet; and a second valve arranged along the fluid manifold, between the reservoir and the secondary pump inlet;

wherein the valve system is operable between:

a first mode, wherein the valve system fluidly connects the internal reservoir outlet to the secondary pump inlet;

a second mode, wherein the valve system fluidly connects the reservoir to the secondary pump inlet; and a purge mode, wherein the first and second valves of the valve system are arranged in an open position, such that valve system fluidly connects the accumulator to the reservoir through the internal reservoir.

2. The system of claim 1, wherein the accumulator is configured to retain a second volume of the fluid at a second pressure higher than the ambient pressure.

3. The system of claim 2, wherein the fluid comprises a compressible fluid.

4. The system of claim 3, wherein the fluid comprises silicone fluid.

5. The system of claim 2, wherein the accumulator comprises a pressurizing mechanism configured to pressurize the second volume of fluid to the second pressure.

6. The system of claim 5, wherein the pressurizing mechanism comprises a sprung wall.

7. The system of claim 2, wherein the reservoir is configured to hold a third volume of the fluid at ambient pressure, the third volume different from the volume and the second volume.

8. The system of claim 1, wherein the fluid preparation system comprises a particulate filter.

9. The system of claim 1, wherein the fluid preparation system further comprises a temperature regulation system.

10. The system of claim 1, wherein the load comprises a hydraulic suspension strut.

11. The system of claim 1, wherein the hydraulic main pump inlet further comprises a valve operable between:

an open mode; and a closed mode in response to a volume within the accumulator falling below a first volume threshold.

12. A method for fluid management within a hydraulic system including a hydraulic main pump fluidly connected to a load, an accumulator fluidly connected to the hydraulic main pump, a fluid preparation system fluidly connected to the hydraulic system and the accumulator, a secondary pump fluidly connected to the fluid preparation system, a reservoir, and a valve system fluidly connecting the reservoir to the hydraulic main pump and the secondary pump, the method comprising:

supplying a fluid from the reservoir at a first pressure to the secondary pump;

pressurizing the fluid from ambient pressure to a second pressure with the secondary pump;

conditioning the fluid by pumping the fluid through the fluid preparation system with the secondary pump;

maintaining a volume of the fluid within the hydraulic main pump with the accumulator;

maintaining the second pressure of the fluid in the accumulator, wherein the second pressure is higher than the first pressure; and providing the fluid to the load with the hydraulic main pump; and in response to receiving a purge request, directing fluid from the accumulator to the reservoir through the valve system; wherein directing fluid from the accumulator to the reservoir through the valve system comprises placing a first and a second valve of the valve system in an open position, wherein the first valve is arranged between the hydraulic main pump, the reservoir, and the secondary pump, and the second valve is arranged between the first valve, the secondary pump, and the reservoir, wherein the valve system further comprises a fluid manifold fluidly connecting the first valve to the second valve.

13. The method of claim 12, further comprising:

measuring a volume of the fluid within the accumulator;

in response to the volume falling below a first threshold, pumping the fluid from the fluid preparation system to the accumulator with the secondary pump.

14. The method of claim 13, wherein pumping the fluid from the fluid preparation system to the accumulator with the secondary pump further comprises closing a valve arranged within the fluid connection between the hydraulic main pump and the accumulator.

15. The method of claim 12, wherein directing fluid from the accumulator to the reservoir through the valve system further comprises ceasing pumping by the secondary pump.

16. The method of claim 13, wherein pumping the fluid from the fluid preparation system to the accumulator with the secondary pump comprises adjusting a pumping pressure of the secondary pump.

* * * * *